United States Patent [19]

Otto

[11] 4,426,906

[45] Jan. 24, 1984

[54] CYMBAL SIZZLER CONSTRUCTION

[76] Inventor: Robert W. Otto, 934 Burt St., Taunton, Mass. 02780

[21] Appl. No.: 447,169

[22] Filed: Dec. 6, 1982

[51] Int. Cl.[3] ..... G10D 13/06

[52] U.S. Cl. ..... 84/402; 84/422 R; 84/453

[58] Field of Search ..... 84/402, 422, 453

[56] References Cited

U.S. PATENT DOCUMENTS

| | | | |
|---|---|---|---|
| 3,009,379 | 11/1961 | Thomas | 84/402 A |
| 3,141,370 | 7/1964 | Ross | 84/402 A |
| 3,677,127 | 7/1972 | Garven | 84/402 A |

FOREIGN PATENT DOCUMENTS

| | | | |
|---|---|---|---|
| 165677 | 12/1958 | Sweden | 84/422 H |

*Primary Examiner*—Lawrence R. Franklin

*Attorney, Agent, or Firm*—Salter & Michaelson

[57] ABSTRACT

A sizzler construction which is usable in combination with a conventional cymbal element and the like to provide a sizzle effect in the sound produced upon impact of the cymbal element. The sizzler includes a chain which overlies the upper surface of the cymbal and which preferably comprises a plurality of loosely interconnected independent metallic ball elements. When the cymbal element is impacted with a drumstick or the like the ball elements independently bounce or vibrate on the upper surface of the cymbal element to provide the desired sizzle effect in the sound produced.

15 Claims, 8 Drawing Figures

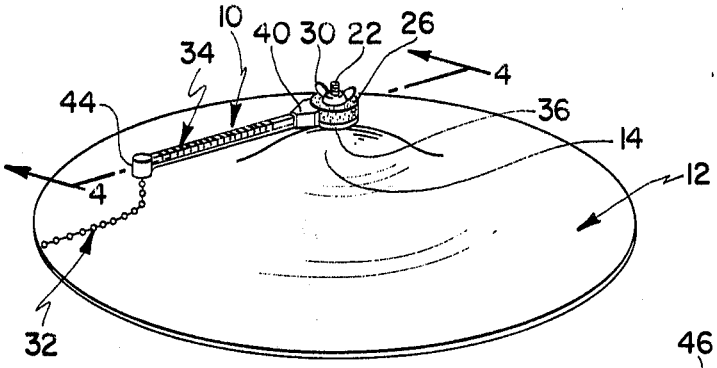
FIG. 1
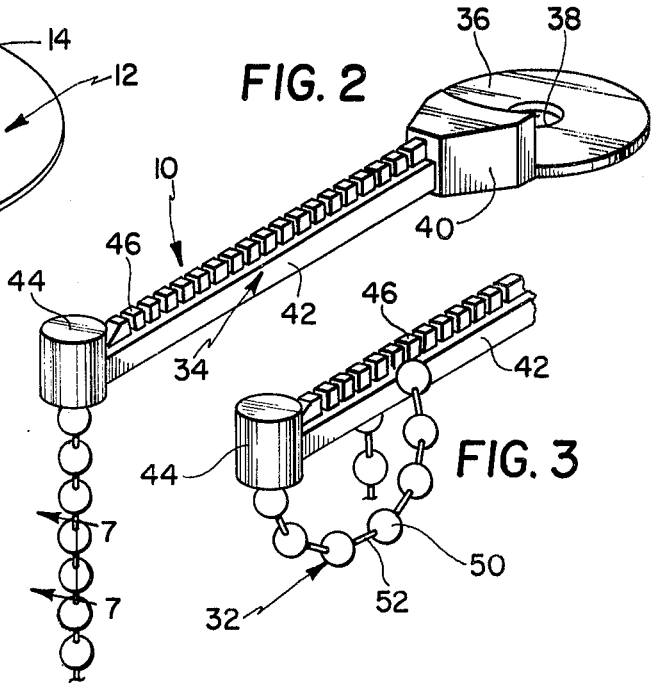
FIG. 2
FIG. 3
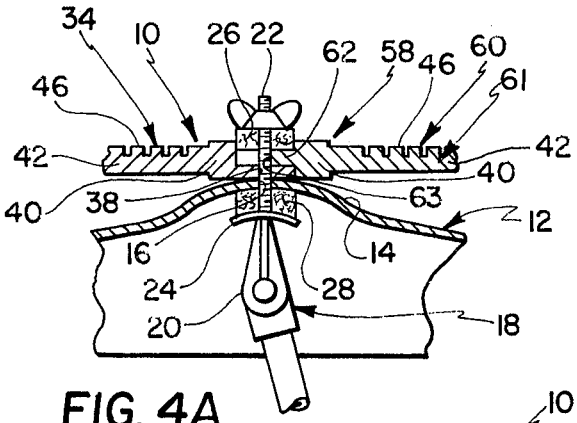
FIG. 4A
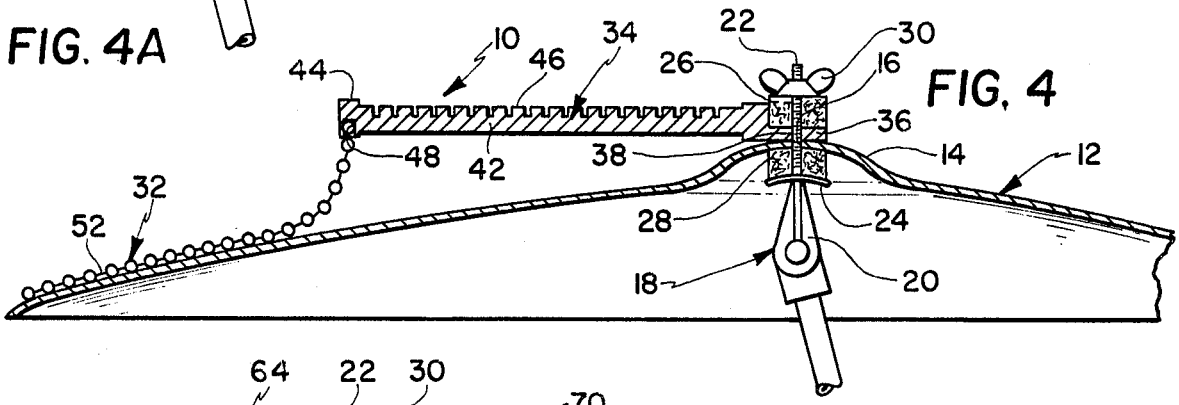
FIG. 4
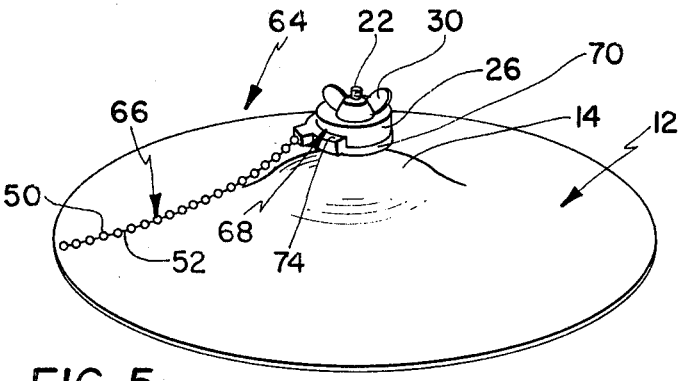
FIG. 5
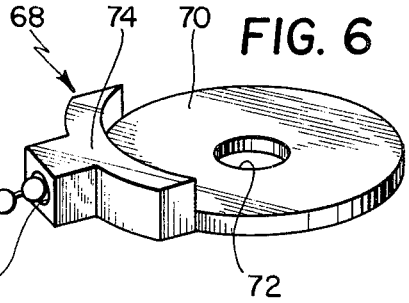
FIG. 6
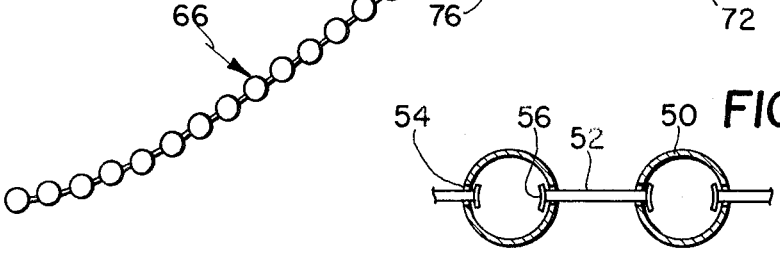
FIG. 7

CYMBAL SIZZLER CONSTRUCTION

BACKGROUND AND SUMMARY OF THE INVENTION

The instant invention relates to cymbals and the like and more particularly to a novel cymbal sizzler construction which is usable in combination with a conventional cymbal element to provide a sizzle effect in the sound produced upon the impact of the cymbal element.

The use of cymbals as percussion instruments is widely known in the musical arts. In this connection, there are certain instances in musical composition where it is desirable to produce sounds having loose vibratory sizzle effects which are superimposed over conventional cymbal sounds. Sounds of this character have heretofore been produced by either utilizing a sizzle cymbal comprising conventional cymbal element which has been permanently modified to provide sizzle effects or by utilizing a device known as a cymbal sizzler in combination with a conventional cymbal element.

The most common type of heretofore known sizzle cymbal construction comprises a conventional cymbal element having a plurality of apertures therein adjacent the outer periphery thereof and a plurality of rivets which are loosely received in the apertures so that the metallic heads of the rivets rest on the upper surface of the cymbal element. When the cymbal element is impacted with a drumstick or the like, the vibration produced therein by the impact causes vibratory engagement between the rivets, particularly the heads thereof, and the cymbal element to provide a sizzle effect. Sizzle cymbals of this type, however, can only be utilized to produce sounds having a sizzle characteristics and cannot be utilized to produce conventional cymbal sounds. Hence, a sizzle cymbal of this type represents an additional instrument which a drummer must purchase, transport and store which results in substantial additional expense and inconvenience.

Several sizzler devices which are usable in combination with conventional cymbal elements have also heretofore been available. Devices of this type have generally comprised an elongated arm which is attachable to a support stand for a cymbal so that when it is used in combination with a cymbal element it extends substantially radially outwardly from the center thereof, and a metallic sizzler element which is attached to the outer end of the arm and which is positionable in engagement with the cymbal element. Accordingly, upon impact of the cymbal element, vibratory engagement between the sizzler element and the upper surface of the cymbal element is effected to produce a sizzle effect. Devices of this general type representing the closest prior art to the instant invention of which the applicant is aware are disclosed in the U.S. Pat. Nos. to THOMAS, 3,009,379; ROSS, 3,141,370; and GARVEN, 3,677,127. While the devices disclosed in the above patents are all operable to produce sizzle effects as above described, they bear very little structural or conceptual similarity to the sizzler construction of the instant invention which represents a substantial improvement thereover as will hereinafter be made apparent. Hence, the above patents are felt to be of nothing more than general interest.

The sizzler construction of the instant invention comprises an elongated chain which preferably comprises a plurality of loosely interconnected hollow spherical metallic balls elements and means which is attachable to a support stand for a cymbal for positioning the chain so that it overlies at least a portion of the upper surface of a cymbal element. Accordingly, when the cymbal element is impacted, the chain vibrates on the upper surface thereof to produce a desired sizzle effect. In this connection, when the chain is embodied as a plurality of loosely intereconnected hollow spherical ball elements, the individual ball elements independently bounce slightly on the upper surface of the cymbal element to produce the desired sizzle effect.

The sizzler construction of the instant invention has several advantages over the sizzler devices of the prior art including those disclosed in the above mentioned patents. Specifically, it has been found that the sizzler construction of the instant invention produces longer lasting more delicate sizzle sounds than the sizzler devices heretofore known. Further, the sizzler construction of the instant invention is easily transportable, it can be manufactured at a substantially reduced cost, and it can be used in combination with a conventional cymbal element of virtually any type or dimension to produce effective sizzle sounds therefrom. The sizzler construction of the instant invention can be embodied with a variety of different chain types and chain lengths and it can be adapted to overlay only certain areas of a cymbal element whereby the sizzler construction can be modified to produce different types of sizzle sounds as desired. Further, in the preferred embodiment of the sizzler construction of the instant invention, the chain element thereof can be easily moved to a nonengaging disposition relative to a cymbal element wherein the cymbal element can be used to produce conventional cymbal sounds without sizzle effects.

Accordingly, it is a primary object of the instant invention to provide a novel sizzler construction for use in combination with a conventional cymbal element.

Another object of the instant invention is to provide a sizzler construction wherein a chain comprising a plurality of interconnected metallic links is overlaid on the upper surface of a cymbal element to produce a desired sizzle sound therefrom.

A further object of the instant invention is to provide a sizzler construction for producing improved sizzle sounds from a conventional cymbal element.

Other objects, features and advantages of the invention shall become apparent as the description thereof proceeds when considered in connection with the accompanying illustrative drawing.

DESCRIPTION OF THE DRAWING

In the drawing which illustrates the best mode presently contemplated for carrying out the present invention:

FIG. 1 is a perspective view of a first embodiment of the sizzler construction of the instant invention as used in combination with a cymbal element;

FIG. 2 is an enlarged perspective view of the sizzler with the chain element thereof fragmentarily illustrated;

FIG. 3 is a fragmentary perspective view of the outer end of the sizzler with the chain element thereof in a nonengaging disposition relative to the cymbal element;

FIG. 4 is a fragmentary sectional view taken along line 4—4 in FIG. 1;

FIG. 4A is a fragmentary sectional view of an alternate embodiment of the sizzler construction which includes two outwardly extending sizzler arms;

FIG. 5 is a perspective view of another alternate embodiment of the sizzler construction of the instant invention as used in combination with a cymbal element;

FIG. 6 is an enlarged perspective view of the sizzler construction illustrated in FIG. 5 per se; and FIG. 7 is a sectional view taken along line 7—7 in FIG. 2.

DESCRIPTION OF THE INVENTION

Referring now to the drawing, a first embodiment of the sizzler construction of the instant invention is illustrated in FIGS. 1 through 4 and generally indicated at 10. The sizzler 10 is usable in combination with a conventional metallic cymbal element generally indicated at 12 to provide a desired sizzle effect in the sound produced therefrom when the element 12 is impacted with a drumstick or the like.

The cymbal element 12 comprises a conventional metallic cymbal element which may be of any desired diameter and which has a central dome or bell portion 14 with a central aperture 16 therethrough. The cymbal element 12 is supported on a conventional support stand which is fragmentarily illustrated and generally indicated at 18 and which has a tilt mechanism 20 from which a threaded shaft 22 extends. Also included in the tilt mechanism 20 are a rigid convex support disc 24 which is received on the lower end of the shaft 22, enlarged upper and lower circular felt pads 26 and 28, respectively, which are also received on the shaft 22 and an upper wing nut 30 which is received in threaded engagement on the shaft 22. The cymbal element 12 is received on the stand 18 so that the shaft 22 extends through the aperture 16 and so that the cymbal element 12 rests on the pad 28 which is supported by the support disc 24. The sizzler 10 is also received on the shaft 22 as will hereinafter be more fully set forth and the upper pad 26 and the nut 30 secure the cymbal element 12 and the sizzler 10 on the stand 18 as illustrated most clearly in FIG. 4.

The sizzler 10 comprises an elongated chain generally indicated at 32 and a sizzler arm generally indicated at 34 from which the chain 32 extends. The arm 34 is received on the shaft 22 and extends substantially radially outwardly therefrom to position the chain 32 so that it overlies the outer portion of the cymbal element 12 as illustrated.

The arm 34 comprises a base portion 36 of substantially flat circular configuration having a central aperture 38 therethrough, a neck portion 40 which extends integrally outwardly from the base portion 36, an elongated intermediate portion 42 which extends outwardly from the neck portion 40 and a terminal portion 44. The arm 34 further comprises a plurality of aligned spaced teeth 46 which extend upwardly from the intermediate portion 42. Preferably the arm 34 is molded in a unitary construction from a generally rigid but at least slightly resiliently flexible plastic material so that the arm 34 will normally maintain the chain 32 in the disposition illustrated but so that the arm 34 will yield slightly if it is inadvertently impacted by a drumstick or the like to prevent damage to the sizzler 10 and/or to the drumstick. The arm 34 is mounted on the stand 18 so that the shaft 22 extends upwardly through the aperture 38 and so that the base portion 36 is interposed between the upper pad 26 and the cymbal element 12 adjacent the aperture 16. The inner periphery of the neck portion 40 is preferably adapted to conform substantially to the circular outer periphery of the upper pad 26 and the intermediate portion 42 extends integrally outwardly from the neck portion 40 in spaced relation above the cymbal element 12 to a point which is above the intermediate area thereof. The terminal portion 44 comprises a generally cylindrically shaped element which is integrally formed on the outer end of the intermediate portion 42 and has a reduced bore 48 which extends upwardly from the lower end thereof.

The chain 32 preferably comprises a plurality of hollow spherical metallic ball elements 50 which are loosely interconnected with reduced wire elements 52. In this regard, as will be seen from FIG. 7, in the preferred embodiment, the ball elements 50 have aligned axial apertures 54 therethrough and the wire elements 52 are received in the apertures 54 of adjacent ball elements 50. Enlarged ends 56 retain the wire elements 52 in the ball elements 50 as illustrated to provide a loose interconnection between the independent ball elements 50 which permits independent vibratory movement of the ball elements 50 on the cymbal element 12 as will hereinafter be set forth. The innermost end of the chain 32 is received in the bore 48 and secured therein with suitable means such as a suitable adhesive or the like. Accordingly, the chain 32 extends downwardly from the terminal portion 44 and is loosely overlaid on the outer portion of the cymbal element 12 as illustrated in FIGS. 1 and 4.

In operation, when the cymbal element 12 is impacted with a drumstick or the like, it vibrates causing the ball elements 50 to vibrate or bounce on the upper surface thereof to provide a desired sizzle effect in the sound produced. In the instant invention as embodied in the sizzler 10, the chain 32 overlays only the outer portion of the cymbal element 12 to eliminate possible dampening effects which could be caused by the weight of the chain 32 if it overlaid the cymbal element 12 from the bell portion 14 thereof to the outer periphery thereof. It will be understood, however, that in other embodiments of the sizzler construction of the instant invention as will hereinafter be set forth it may be desirable to have the respective chain elements thereof extend outwardly from the respective bell portions 14 to the outer peripheries of the respective cymbal elements 12 to produce somewhat different sizzle effects. Further, in this connection, it will be understood that by varying the weights and/or types of the chains utilized, the qualities of the sizzle effects produced can be altered as desired and that therefore other embodiments of the instant invention which include chains of different types are contemplated.

Referring particularly to FIG. 3, the inoperative position of the sizzle 10 is illustrated. In this regard, it will be seen that by positioning the chain 32 so that one of the wire elements 52 thereof is received in the space between a pair of adjacent teeth 46, the chain can be moved to a nonengaging disposition wherein it does not touch the cymbal element 12. Accordingly, when the chain 32 is so positioned, convention cymbal sounds can be produced from the cymbal element 12.

A second embodiment of the sizzler construction of the instant invention is illustrated in FIG. 4A and generally indicated at 58. The sizzler 58 which is a dual sizzler comprises a sizzler 10 plus a sizzler 60 which is similar in configuration to the sizzler 10 but which is modified slightly so that both the sizzlers 10 and 60 can easily be accomodated on the shaft 22. Specifically, the sizzler 60 comprises a sizzler arm 61 having a neck portion 40 and a base portion 62 having an aperture 63 therein. The base portion 62 is slightly upwardly spaced from the lower surface of the neck portion 40 as illustrated. Accordingly, both the sizzlers 10 and 60 can be accommodated on the shaft 22 with the base portions 36 and 62, respectively, thereof nested together and with the upper pad 26 engaging the base portion 62 as illustrated. Obviously, the sizzler 58 also includes a chain 50 (not shown) to provide the desired sizzle effects therefrom.

A third embodiment of the sizzler construction of the instant invention is illustrated in FIGS. 5 and 6 and generally indicated at 64. The sizzler 64 is also usable in combination with a cymbal element 12 and comprises a chain generally indicated at 66 and a mounting bracket generally indicated at 68 which is attachable to the stand 18, specifically the shaft 22 thereof. The mounting bracket 68 comprises a base portion 70 which is similar in configuration to the base portion 36 and has an aperture 72 therethrough and a neck portion 74 having a terminal bore 76 therein. The innermost end of the chain 66 is received in the bore 76 and secured therein with suitable means such as an adhesive or the like. As illustrated in FIG. 5 when the sizzler 64 is received on the shaft 22, the bracket 68 positions the chain 66 so that it loosely overlays the cymbal element 12. As herein embodied, the chain 66 is dimensioned to overlay the cymbal element 12 from the bell portion 14 thereof to the outer periphery thereof. The sizzler construction 64 operates in a manner similar to the sizzler constructions 58 and 10, the ball elements 50 vibrating or bouncing on the surface of the cymbal element 12 when it is impacted.

It is seen therefore the instant provides an effective sizzler construction for use in combination with a conventional cymbal element. In this regard, the sizzlers 10, 58 and 64 all provide improved sizzle characteristics when used as hereinabove set foth. The sizzlers 10, 58 and 64 are also easily transportable and adapted for relatively inexpensive constructions. For these reasons as well as the other reasons hereinabove set forth, the sizzler construction of the instant invention represents a significant improvement in the musical art which has substantial commercial merit.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A sizzler construction in combination with a cymbal element comprising:

(a) a cymbal element;

(b) an elongated chain; and (c) means for securing said chain so that at least a portion thereof overlies the upper surface of said cymbal element.

2. In the sizzler construction of claim 1, said chain comprising a plurality of interconnected independent chain elements.

3. In the sizzler construction of claim 1, said chain further characterized as a metallic chain.

4. In the sizzler construction of claim 2, said chain comprising a plurality of interconnected independent chain elements.

5. In the sizzler construction of claim 4, said chain elements further characterized as being substantially spherical ball elements.

6. In the sizzler construction of claim 5, said ball elements further characterized as being hollow and each having at least one pair of substantially axially aligned apertures therethrough, said ball elements being loosely interconnected with reduced wire elements which are received in the apertures in adjacent ball elements.

7. In the sizzler construction of claim 1, a support stand supporting said cymbal element in the central portion thereof, said chain securing means being mounted on said support stand adjacent the central portion of said cymbal element.

8. In the sizzler construction of claim 7, said cymbal element having a central aperture therethrough, said support stand including a shaft portion which extends through said aperture, said securing means being mounted on said shaft.

9. In the sizzler construction of claim 7, said securing means comprising an arm which is attached to said stand adjacent the central portion of said cymbal element and which which extends outwardly in upwardly spaced relation therefrom, said chain being attached to said arm at a point which is in upwardly spaced relation to an intermediate point on said cymbal element between the outer periphery thereof and said central portion whereby said chain overlies only the outer portion of said cymbal element.

10. In the sizzler construction of claim 9, said arm being slightly resiliently flexible.

11. The sizzler construction of claim 9, further comprising a plurality of said arms each having a chain attached thereto.

12. The sizzler construction of claim 9, further comprising releasable retaining means on said arm for releasably retaining said chain in a nonengaging position relative to said cymbal element.

13. In the sizzler construction of claim 12, said retaining means comprising a plurality of spaced teeth, said chain being receivable between adjacent teeth and thereby being retainable in said nonengaging position.

14. In the sizzler construction of claim 1, said chain overlying only the outer portion of said cymbal element.

15. In the sizzler construction of claim 1, said chain overlying said cymbal element from said central portion thereof substantially to the outer periphery thereof.

* * * * *